United States Patent [19]

Yamanaka

[11] Patent Number: 4,986,684

[45] Date of Patent: Jan. 22, 1991

[54] MULTIANGULAR PEN

[76] Inventor: Shizuo Yamanaka, 4-16-13-301, Shimo-renjaku, Mitaka-shi, Tokyo, Japan

[21] Appl. No.: 390,785

[22] Filed: Aug. 8, 1989

Related U.S. Application Data

[62] Division of Ser. No. 280,487, Dec. 6, 1988.

[30] Foreign Application Priority Data

| | | | |
|---|---|---|---|
| Dec. 7, 1987 | [JP] | Japan | 62-307566 |
| Aug. 4, 1988 | [JP] | Japan | 63-193412 |
| Sep. 14, 1988 | [JP] | Japan | 63-120957[U] |

[51] Int. Cl.[5] ..... B43K 5/18; B43K 3/00

[52] U.S. Cl. ..... 401/224; 401/241; 401/249

[58] Field of Search ..... 401/198, 199, 222, 223, 401/224, 238, 252, 221, 241, DIG. 3, 249, 250

[56] References Cited

U.S. PATENT DOCUMENTS

| | | | |
|---|---|---|---|
| 3,604,817 | 9/1971 | Funahashi | 401/199 |
| 4,386,867 | 6/1983 | Yamanaka | 401/222 |
| 4,465,391 | 8/1984 | Kinjo | 401/238 X |

*Primary Examiner*—Randall L. Green
*Assistant Examiner*—David H. Willse
*Attorney, Agent, or Firm*—Browdy and Neimark

[57] ABSTRACT

This invention presents a multiangular pen in which a pen nib is inserted and housed in a pen nib housing hole provided on a pen nib holder sleeve. Further, a push sleeve having a guide hole extending in its longitudinal direction and communicating with the pen nib housing hole is fitted into the pen nib housing hole at the back end side of the pen nib holder sleeve to support the pen nib. In the guide hole and the pen nib housing hole, an ink introducing core is inserted.

8 Claims, 7 Drawing Sheets

FIG. 1
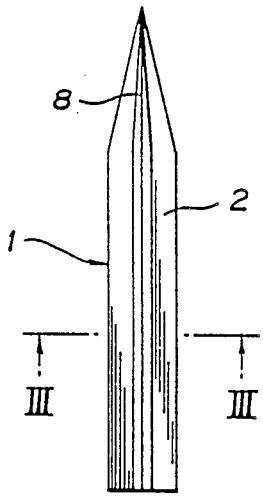
FIG. 2
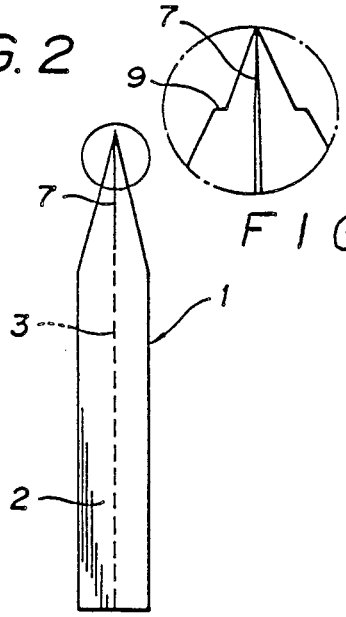
FIG. 2A
FIG. 3
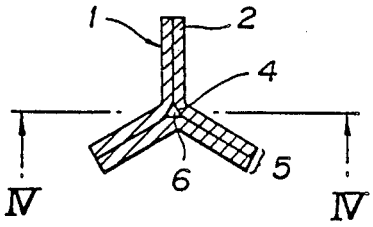
FIG. 4
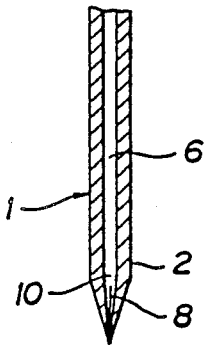

MULTIANGULAR PEN

This is a division of application Ser. No. 280,487, filed Dec. 6, 1988.

BACKGROUND OF THE INVENTION

1. Field of the Invention

The present invention relates to a multiangular pen excellent in rigidity and durability and easily manufactured.

2. Description of the Prior Art

In order to overcome the disadvantage that writing can be done only in one angular direction when the conventional writing means having a piece of pen nib is used, there has been proposed a multiangular pen comprising plural pen nib pieces (or three pen nib pieces, for example) each having substantially same construction as that of the conventional pen nib and said pen nib pieces being bonded back-to-back to one another to enable writing to be done in all directions.

The conventional one of these multiangular pens is disclosed by U.S. Pat. No. 4,465,391, for example. This multiangular pen comprises a pen nib having a trunk extending in the longitudinal center axis and projections radially and outwardly projected from the trunk with a certain angular interval of about 120° interposed between the projections, and a pen core closely contacted with the outer surface of the pen nib to hold the latter.

In the case of this pen nib assembly, however, it must be arranged that the pen core is made of synthetic resin and that fine ink passages which allow ink to flow to the front end of the pen nib due to the capillarity are formed at the barrel portion of the pen core. This takes a long time and makes the process difficult.

Holder pieces which are intended to closely contact with the outer surface of the pen nib must be shaped to meet the pen nib and this asks accuracy in the manufacturing process.

The pen nib is fitted into a holder at the front end of the pen core and supported by this holder. Depending upon force added to the pen nib, therefore, it happens that the holder is bent and deformed to make the pen nib unsteady.

SUMMARY OF THE INVENTION

A first object of the present invention is to provide a multiangular pen having a rigid pen nib and capable of substantially reducing the difficulty of manufacturing the pen.

A second object of the present invention is to provide a multiangular pen capable of carrying out the pen nib assembly with reliability.

In order to achieve these objects, the present invention provides a multiangular pen comprising a multiangular pen nib provided with a trunk extending in the longitudinal direction of the pen, and plural projections projected radially and outwardly from the trunk with a certain angular interval interposed between the projections; a pen core having holder pieces fitted onto the pen nib and a rod-like connector formed integral to the holder pieces at the base end of the pieces, said pen core being made by tamping and molding a fibers material, having liquid-permeability and contacting with the surface of the pen nib to hold the latter; and a penholder having an ink reservoir therein and housing a pen nib assembly of the pen nib and the pen core; wherein the core body of the pen core is inserted into an ink holding member.

According to the first example of the multiangular pen, ink enters from the ink reservoir directly into the pen core. The pen core is made of fibers material and the ink passes through the fibers. In other words, the ink moves from the ink holding member to the base end of the pen core and then passes through the pen core so as to be smoothly introduced and supplied to the pen nib. When the ink is introduced to the vicinity of the front end of the pen nib and then to the predetermined position of the holder pieces, it enters into the pen nib, passing through clearances such as slits and splits, and as it comes to the front end of the pen nib, it is stored in an ink chamber in the pen nib. In the case where the pen nib is made of ceramic, it is hardly deformed and damaged even if it is subjected to slight impacts.

The present invention provides another example of the multiangular pen comprising a multiangular pen nib, a pen nib holder sleeve having a hole extending in the center axis of the sleeve to house the pen nib and also having a tapered portion whose diameter becomes smaller and smaller as it comes nearer and nearer the front end of the sleeve, a push sleeve having a guide hole extending in its longitudinal direction and communicating with the pen nib housing hole in the holder sleeve, said push sleeve being fitted into the pen nib housing hole at the back end portion of the pen nib holder sleeve to strike against the back end of the pen nib, and ink introducing cores extending to the slits of the pen nib, passing through the guide hole and the pen nib housing hole, wherein a stopper section is formed on the inner face of the pen nib housing hole in the pen nib holder sleeve to fix and hold the pen nib and holder pieces each having a passage in which the ink introducing core is passed are formed integral to the pen nib holder sleeve at the front end thereof.

According to this second example of the multiangular pen, the base end portions of the ink introducing cores are inserted into the ink reservoir in the multiangular pen to have the supply of ink. The ink which has entered into the ink introducing cores is introduced to the center of the pen nib, passing through the ink introducing cores, the hollow portion of the pen nib holder sleeve, and passages in the holder pieces located at the front end of the pen nib holder sleeve. The ink introducing cores are made of fibers material and ink is introduced to their front ends due to their capillarities and fed to the front end portion of the pen nib. The pen nib is stopped and fixed in the pen nib holder sleeve by the stopper section on the inner face of the holder sleeve. This prevents the pen nib from becoming loose relative to the pen nib holder sleeve and to the penholder, thereby keeping the pen steady while it is used to write something on a sheet of paper.

The present invention provides a further example of the multiangular pen comprising a channel extending along the center axis of the pen nib, a pen nib holder sleeve substantially same as the one of the abovedescribed second example, a push sleeve, and an ink introducing core extending to the slits of the pen nib, passing through the guide hole in the push sleeve, pen nib housing hole in the pen nib holder sleeve, and channel in the pen nib, wherein a stopper section is provided on the inner face of the pen nib housing hole in the pen nib holder sleeve to fix and hold the pen nib in the holder sleeve.

According to the third example of the multiangular pen, the pen nib is fixed and held in the pen nib holder sleeve by the stopper section as seen in the second example. This prevents the pen nib from becoming loose relative to the pen nib holder sleeve and to the penholder, thereby keeping the pen steady while it is used to write something on a sheet of paper.

The present invention will be described in detail with reference to the accompanying drawings.

BRIEF DESCRIPTION OF THE DRAWINGS

FIG. 1 is a front view showing a pen nib employed by a first example of the multiangular pen according to the present invention.

FIG. 2 shows the pen nib viewed from its back side.

FIG. 2*a* shows an enlarged view of the pen nib point encircled in FIG. 2.

FIG. 3 is a sectional view taken along a line III—III in FIG. 1.

FIG. 4 is a sectional view taken along a line IV—IV in FIG. 3.

DETAILED DESCRIPTION OF THE PREFERRED EMBODIMENTS

Figure 5:
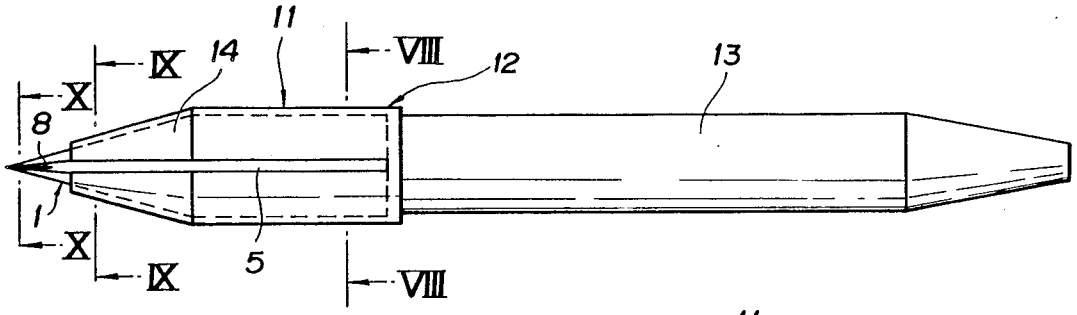
FIG. 5 is a front view showing a pen nib assembly according to the present invention.

FIGS. 1 through 10 show a first embodiment of the present invention.

Reference numeral 1 represents a pen nib, which comprises pin nib pieces 2 each made of metal or ceramic. This pen nib piece 2 is bent to an angle of about 120° along its longitudinal center line 3 and the corner thus formed along the longitudinal center line 3 is substantially sharp (FIG. 3). The pen nib piece 2 is provided with notches 9 adjacent to its pointed tip and on its both tapered sides, as shown enlarged in FIG. 2*a*.

Figure 6:
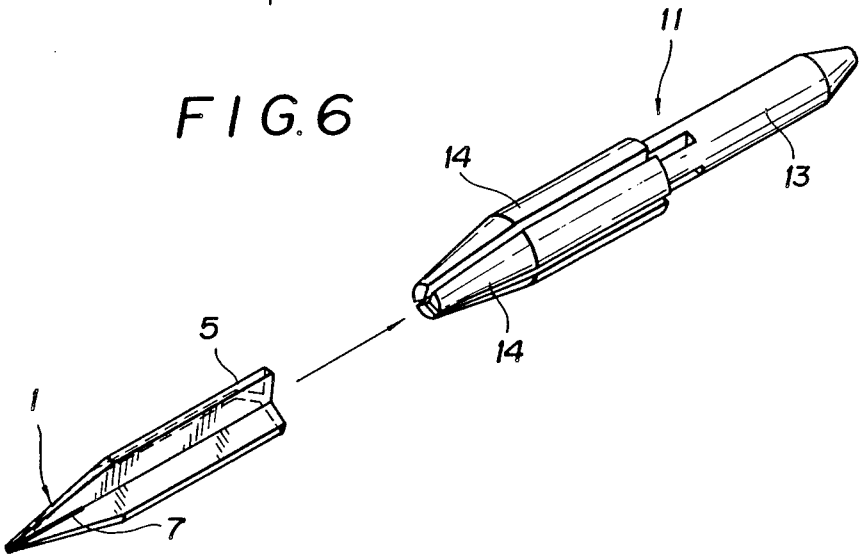
FIG. 6 is a perspective view showing how the pen nib assembly employed by the first example is assembled.

The pen nib 1 comprises bonding three pen nib pieces 2 back-to-back by spot welding and gathering their pointed tips together. Different from the conventional ones, the pen nib 1 includes a comparatively slim trunk 4 formed by three corners of the pen nib pieces 2, and projections 5 formed by wings of the pen nib pieces 2 extending radially and outward from the trunk 4 and provided with an angle of 120° between the adjacent projections 5. Each of the pen nib pieces 2 is sharply bent along its longitudinal center line 3 and a channel 6 having such a small radius that ink is subject to the capillarity is formed along the longitudinal center axis of the trunk 4 of the pen nib 1, as shown in FIG. 4. Each of the pen nib pieces 2 is provided with a slit 7, about 8 mm long, extending downward from its pointed tip along the longitudinal center line 3. Further, a clearance 8, 2 or 3 mm long, is formed along the notches 9 between the adjacent pen nib pieces 2 at each of the projections 5 of the pen nib 1. Therefore, the pen nib 1 is provided around the pointed tip and its vicinity with three comparatively long slits 7 and three comparatively short clearances 8. These slits 7 and clearances 8 are alternately arranged around the pointed tip and its vicinity of the pen nib 1 with a certain angular interval interposed between the slit 7 and the clearance 8. When writing something of letters on a sheet of paper, these slits 7 and clearances 8 form passages through which ink is introduced onto the sheet of paper. The pointed tip and its vicinity of the pen nib 1, said tip being formed by gathering three tips of the pen nib pieces 2 together, are formed as a pyramid (or triangular pyramid) having an ink chamber 10 therein. The channel 6 extends from the base to the tip of the pen nib 1 along the longitudinal center axis thereof and communicates with the slits 7 and clearances 8. As shown in FIG. 6, the pen nib 1 having the abovedescribed arrangement is attached to a pen core 11, which is formed by tamping and molding a liquid permeating material, to form a pen nib assembly 12 (FIG. 5).

The pen core 11 comprises a core body 13 and a holder 14 molded integral to the core body 13. The holder 14 is divided into three same holder pieces, each of which has such a section that can fit the trunk 4 of the pen nib 1 between the projections 5 thereof. When the pen nib 1 is inserted into the holder 14, the inner face of each of the holder pieces elastically contacts with the outer face of the trunk 4 of the pen nib 1, holding the projections 5 in those splits by which the holder 4 is divided into three same holder pieces. The pen nib 1 is assembled with the pen core 11 as a unit (FIG. 5).

The pen body 13 is located behind the holder 14 or on the base side thereof to be connected to the ink reservoir in the penholder. The pen body 13 has a diameter a little smaller than that of the lower portion of the holder 14.

The liquid permeating material by which the pen core 11 is made may be polyester, nylon, acryl, felt, glass fibers, or cotton.

Figure 7:
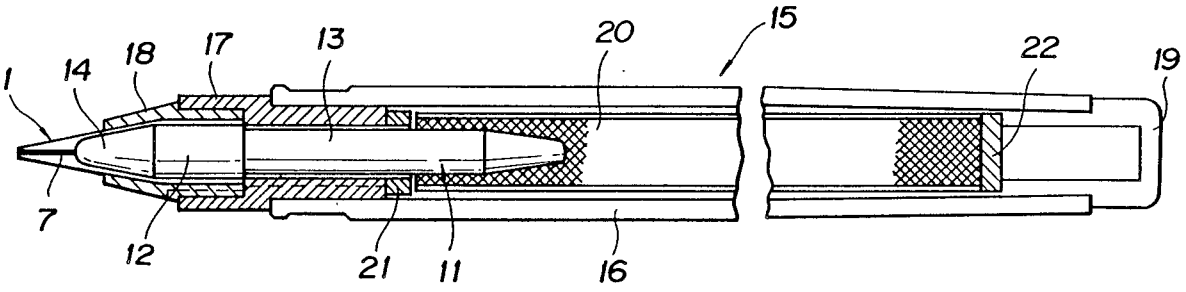
FIG. 7 is a sectional view showing the inside construction of the first example according to the present invention.

The pen nib assembly 12 consisting of the pen nib 1 and the pen core 11 is attached to the front end portion of the penholder 15 to form a pen, as shown in FIG. 7. The penholder 15 comprises a cylindrical body 16, a holder means 17 attached to the front end of the cylindrical body 16, and a plug member 19 for closing the back end of the cylindrical body 16. The cylindrical body 16 has a slender container chamber in it which is closed at the back end but opened at the front end thereof. The container chamber in the cylindrical body 16 is filled with an ink holding member 20 in which ink has been contained. This ink holding member 20 is made by bundling fibers of polyester, polypropylene or nylon and wrapping the bundle of fibers by a sheet of film made of polyethylene, cellophane or polypropylene. It holds ink among its fibers due to the capillarity and it is sealed in the container chamber in the cylindrical body 16 by a ring-shaped sealing member 21 at its front end and by another sealing member 22 at its back end. The sealing member 21 is located between the ink holding member 20 and the holder means 17 while the other sealing member 22 between the ink holding member 20 and the plug member 19. The pen core 11 of the pen nib assembly which is held by the holder means 17 and a mouth piece 18 extends backward into the ink holding member 20 through the sealing member 21 to form an ink introducing passage.

Figure 10:
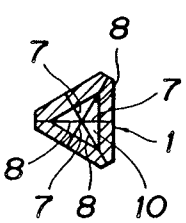
FIG. 10 is a sectional view taken along a line X—X in FIG. 5.
Figure 9:
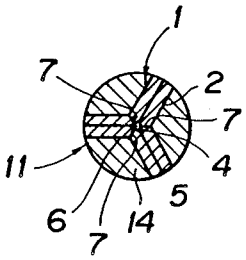
FIG. 9 is a sectional view taken along a line IX—IX in FIG. 5.
Figure 8:
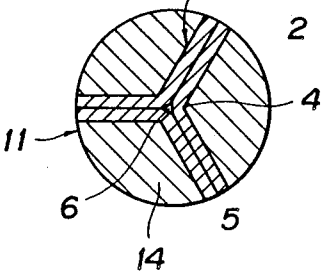
FIG. 8 is a sectional view taken along a line VIII—VIII in FIG. 5.

The ink in the ink holding member 20 enters into the base portion of the pen core 11 and passes through the fibers of the pen core 11. After being introduced adjacent to the pointed tip of the pen nib 1 through the pieces of the holder 14, as shown in FIG. 8, the ink enters into the pen nib 1, passing through the slits 7, and it is stored in the ink chamber 10 as it comes nearer and nearer to the pointed tip of the pen nib 1, as shown in FIG. 10. A little amount of ink is also introduced into the ink chamber 10, passing through the channel 6.

The ink stored in the ink chamber 10 permeates again outside the pen nib 1 through the clearances 8 and slits 7 whenever the pen is used to write something on a sheet of paper. As described above, the ink chamber 10 serves to house the ink through the slits 7 which are overlapped with the pieces of the holder 14, said ink having flowed from the ink holding member 20 through the pen core 11. The ink chamber 10 then allows the ink to come to the clearances 8 and to permeate outside the pen nib 1 through the clearances 8 and slits 7. The pieces of the holder 14 overlaps the slits 7 and contacts with the surface area of the pen nib 1 closely and elastically. This prevents air from entering from outside into the ink passage to disturb the flow of ink. This also prevents ink from flowing outside, passing between the pieces of the holder 14 and the pen nib 1. Therefore, ink is allowed to enter into the ink chamber 10 through the slits 7 and permeate outside through one of the six clearances 8 and slits 7 at that portion of the ink chamber 10 which is nearer to the pointed tip of the pen nib 1. This flowing of ink into and out of the ink chamber 10 depends largely upon the capillarity of the clearances 8 or slits 7. Even when the pen is left with its pointed tip directed upward, ink is held by the capillarities of the slits 7 and pen core 11, thereby preventing ink from flowing back from the ink chamber 10. The channel 6 has the small diameter, as described above. Even if ink is left in the channel 6, therefore, the flowing-back of this ink can be stopped due to the capillarity of the channel 6. This enables the user to use the pen whenever he wants to write something on a sheet of paper.

According to this embodiment of the present invention as described above, ink can be supplied into the pen nib through the clearances at the pointed tip and its vicinity of the pen nib. This makes it rare that the fibrous matter of paper enters into the ink chamber to jam the ink-introducing clearances.

Further, the holder and body of the pen core which are made by a liquid-permeating material and combined as a unit are connected to the ink holding member. Therefore, ink can be introduced near the pointed tip of the pen nib due to the capillarity, passing through the pen core from the ink holding member. This enables ink to be stably introduced from the ink container chamber to the vicinity of the pointed tip of the pen.

Furthermore, the slits are overlapped with the pieces of the holder. This prevents air from entering into the slits to disturb the flow of ink. This also prevents ink from flowing outside from between the pieces of the holder and the pen nib to fall as a drop of ink. In addition, the pen nib is made of metal or ceramic. Even when the pen is subjected to something of shock, therefore, it can be kept normal without being deformed and damaged. This enables anyone to enjoy writing with the multiangular pen of the present invention.

FIGS. 11 through 15 show a second example of the multiangular pen according to the present invention. The construction of this multiangular pen nib is quite same as that of the first embodiment.

Figure 11:
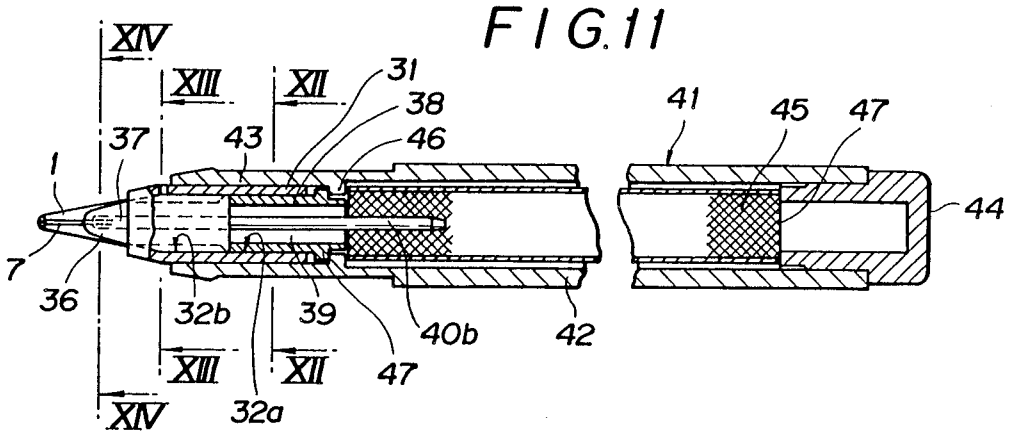
FIG. 11 is a sectional view showing the inside construction of a second example of the multiangular pen according to the present invention.
Figure 12:
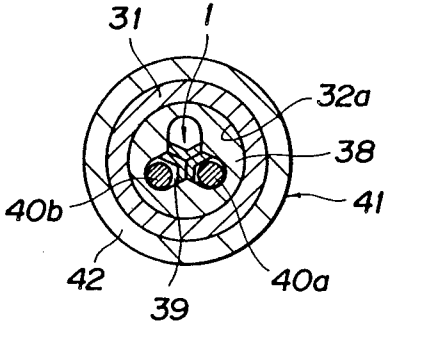
FIG. 12 is a sectional view taken along a line XII—XII in FIG. 11.
Figure 13:
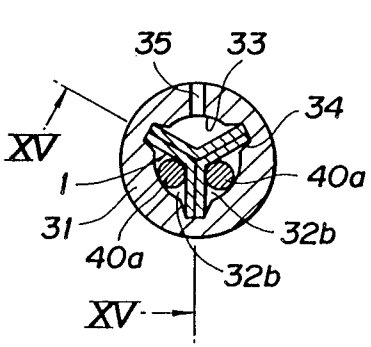
FIG. 13 is a sectional view taken along a line XIII—XIII in FIG. 11.
Figure 14:
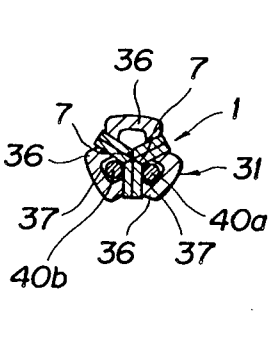
FIG. 14 is a sectional view taken along a line XIV—XIV in FIG. 11
Figure 15:
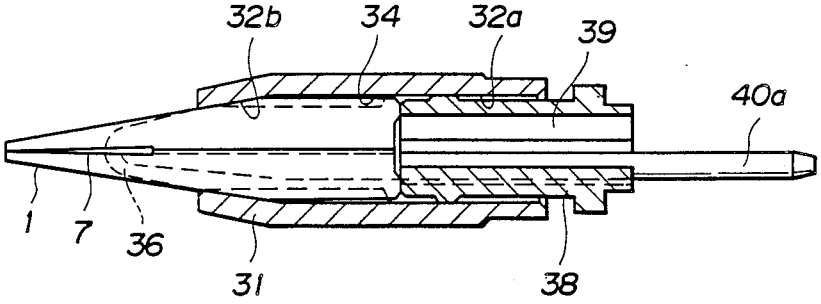
FIG. 15 is an enlarged sectional view taken along a line XV—XV in FIG. 13 showing in detail a pen nib assembly employed by the second example of the multiangular pen.
Figure 16:
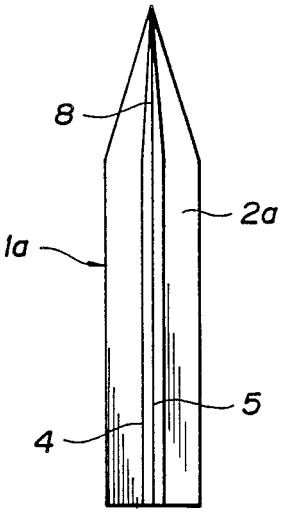
FIG. 16 is a front view showing a pen nib employed by a third example of the multiangular pen according to the present invention.

FIG. 11 is a sectional view showing an arrangement of the multiangular pen. Numeral 31 denotes a sleeve for fixing and holding the pen nib. The pen nib holding sleeve 31 is a cylinder tapered at the front end portion thereof and the diameter in this tapered portion becomes smaller as it comes nearer the front end. As apparent from FIG. 11, holes **32*a* and 32*b* for housing the pen nib are formed in the cylinder. The pen nib housing holes 32*a* and 32*b* are communicated with each other in the pen nib holder sleeve 31. As shown in FIG. 12, the pen nib housing hole 32*a* located on the base side of the pen nib holder sleeve 31 has a substantially circular section. The pen nib housing hole 32*b* located on the front end side of the pen nib holder sleeve 31 is provided with pen nib fixing grooves 34 on its inner face 33. As shown in FIGS. 11 and 13, the pen nib fixing grooves 34 are radially formed on and extended along the inner face 33 of the pen nib housing hole 32*b*, with an interval of 120° interposed between the adjacent grooves 34. An air hole 35 is also radially formed, passing through the wall of the pen nib holder sleeve 31. Further, the pen nib holder sleeve 31 is provided at the front end thereof with holder pieces 36 each having such a section that can be fitted between the projections 5 of the pen nib 1 and also having a passage 37 therein communicated with the pen nib housing hole 32*b*. When the pen nib 1 is attached to the pen nib holder sleeve 31, the outer face of the trunk 4 and the inner face of the holder piece 36 are combined with each other to form the passage 37 at the front end portion of the pen nib 1, as shown in FIG. 14. Each of the passages 37 is terminated just a little before the front end of the holder piece 36**.

Reference numeral 38 represents a push sleeve inserted into the pen nib housing hole **32*a* from the base end of the pen nib holder sleeve 31. The push sleeve 38 is provided with three grooves 39 radially formed on the inner face thereof with an interval of 120° interposed between the grooves 39. The outer diameter of the push sleeve 38 is made a little larger than the inner diameter of the pen nib housing hole 32***a*. The push sleeve 38 is forcedly pushed into the pen nib housing hole 32*a* and fixed there.

Reference numerals 40*a* and 40*b* represent ink introducing cores, each of which has such an outer diameter that enables the ink introducing core itself to be inserted into the groove 39 in the push sleeve 38, but this outer diameter of each of the ink introducing cores is made so smaller at the front end portion as to enable the core itself to be inserted through the passage 37 in the holder piece 36. The ink introducing cores 40*a* and 40*b* made of a liquid permeating material such as polyester, nylon, acryl, felt, glass fibers and cotton.

The pen nib 1 is inserted into the pen nib housing holes 32*a* and 32*b* in the pen nib holder sleeve 31 from the base end (or back end) of the pen nib holder sleeve 31. The front end portion of the pen nib 1 is tapered and when the pen nib 1 is inserted through the pen nib housing holes and its front end portion is projected by a certain length from the front end of the pen nib holder sleeve 31, therefore, it is stopped by the front inner rim of the pen holder sleeve 31. When the push sleeve 38 is pushed this time into the pen nib housing hole 32*a* at the base end side of the pen nib holder sleeve 31, its front end strikes against the back end of the pen nib 1 in the pen nib holder sleeve 31 to fix and hold the pen nib 1 in the pen nib holder sleeve 31. When the pen nib 1 is inserted into the pen nib holder sleeve 31, the projections 5 of the pen nib 1 are fitted into the grooves 34, respectively, on the inner face 33 of the pen nib housing hole 32*b* and the movement of this pen nib 1 is thus restricted both in its rotating direction and a direction perpendicular to its center axis. When the push sleeve 38 is inserted into the pen nib holder sleeve 31, the movement of the pen nib 1 is also restricted in a direction of its center axis. The ink introducing cores 40*a* and 40*b* are inserted into the push sleeve 38 along the grooves 39 at the base end of the pen holder sleeve 31. In the case of this embodiment, two ink introducing cores 40*a* and 40*b* are inserted into two of the three-forked grooves 39. The ink introducing cores 40*a* and 40*b* extend into the pen nib housing hole 32*b* in the pen nib holder sleeve 31, passing through the grooves 39, and then reach the passages 37 in the holder pieces 36, passing through the pen nib housing hole 32 partitioned by the pen nib 1. The front ends of the ink introducing cores 40*a* and 40*b* are contacted with the slits 7 at the front ends of the passages 37, said slits 7 being formed at the tips of the trunk 4 of the pen nib 1. One of the passages 37 in the pen nib housing hole 32*b* partitioned by the pen nib 1 and having no ink introducing core therein is communicated with outside the pen nib holder sleeve 31 through the air hole 35.

When the pen nib 1, pen nib holder sleeve 31, push sleeve 38 and ink introducing cores 40*a* and 40*b* are assembled with one another, as described above, a pen nib assembly of the multiangular pen can be provided. This pen nib assembly is attached to a penholder 41.

The penholder 41 comprises a cylindrical body 42, a holder section 43 attached to the front end of the cylindrical body 42, and a plug member 44 for closing the back end of the cylindrical body 42. The inside of the cylindrical body 42 is opened at its front end and closed at its back end by the plug member 44, so that a slender container chamber can be formed in the cylindrical body 42. An ink holding member 45 in which ink has been contained is packed in this slender container chamber. The ink holding member 45 is contacted at its front end with a ring-shaped flange 46 radially projected from the inner face of the cylindrical body 42, while it is contacted with the plug member 44 at its back end. The ink holding member 45 is thus fixed in the container chamber of the cylindrical body 42. The ink introducing cores 40*a* and 40*b* in the pen nib assembly held by the holder section 43 are projected into the ink holding member 45 in the cylindrical body 42 at their back end portions to form ink introducing passages. The flange 46 is struck against a ring-shaped flange 47 projected radially and outward from the outer circumference of the push sleeve 38, so that the push sleeve 38 can be fixed not to move in forward and backward directions in the pen nib housing hole 32*b*.

The ink which has moved from the ink holding member 45 to the base portions of the ink introducing cores 40*a* and 40*b* passes through the fibers in the ink introducing cores. It is then introduced near the pointed tip of the pen nib 1, passing through the grooves in the push sleeve 38, the pen nib holder sleeve 31 partitioned by the pen nib 1, and the passages in the holder pieces 36. The ink introducing cores 40*a* and 40*b* are contacted with the slits 7 at and near the front ends of the holder pieces 36, as already described above. This enables the ink to enter into the pen nib 1 through the slits 7 and when the ink reaches the front end of the pen nib 1, it is stored in the ink chamber 10 at the front end of the pen nib 1 (see FIG. 10).

When the user uses the pen to write something on a sheet of paper, ink stored in the ink chamber 10 permeates outside the pen nib 1 through all of the clearances 8 and slits 7 surrounding the ink chamber 10. The ink chamber 10 serves to house the ink, which has flowed from the ink holding member 45 to the ink introducing cores 40*a* and 40*b*, into the pen nib 1 through the slits 7. The ink chamber 10 which further allows the ink to come to all of the six clearances 8 and slits 7 and to permeate outside the pen nib through the clearances 8 and slits 7 in same manner. The ink introducing cores 40*a* and 40*b* are closely contacted with the slits 7 at that area of the pen nib where ink enters into the ink chamber 10 and the holder pieces 36 are closely and elastically contacted with the pen nib 1, surrounding those ink introducing cores and the slits which are closely contacted with each other. This prevents air from entering from outside into the ink passages to disturb the flow of ink. This also prevents ink from coming out of the ink introducing cores 40*a* and 40*b* and flowing outside from between the holder pieces 36 and the pen nib 1. The ink is thus caused to enter into the ink chamber 10 through the slits 7 and when it comes nearer the front end of the pen nib 1, it permeates outside the pen nib 1, passing through any one of the six clearances 8 and slits 7. This moving of ink into and out of the ink chamber 10 depends largely upon the capillarities of the clearances 8 and slits 7. Even when the pen is left unused or its pen nib is directed upward, ink can be held due to the capillarities of the slits 7 and ink introducing cores 40*a* and 40*b*, thereby preventing the ink from flowing back from the ink chamber 10. The user can enjoy his writing whenever he wants to write something on a sheet of paper.

According to the second example of the multiangular pen, a through-hole is provided in the pen nib holder member, extending in the longitudinal direction of the holder member, and the ink introducing cores made of liquid-permeating material are inserted in this through-hole and contacted with the ink holding member, for the purpose of supplying ink into the pen nib through the slits arranged at the pen nib. Ink can be thus introduced from the ink holding member to the vicinity of the pen nib, passing through the ink introducing cores, because the capillarity is kept all the way of the ink passage. This enables ink to be stably introduced from the ink holding member to the vicinity of the pen nib. Further, the pen nib is inserted into the pen nib holder sleeve and fixed there not to move in any direction. In addition, it is pushed and held at its back end by the push sleeve. The attaching and fixing of the pen nib relative to the penholder can be thus achieved with reliability to make the pen steady while it is being used to write something on a sheet of paper. When the pen nib is made of ceramic, the tip portion of the pen nib is hardly deformed and damaged even if it is subjected to slight impacts, thereby keeping the pen ready whenever the user wants to use it.

FIGS. 16 through 22 show a third example of the multiangular pen according to the present invention.

Figure 17:
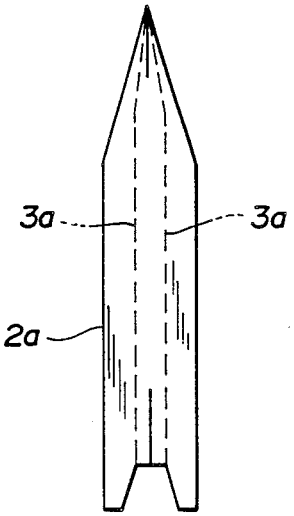
FIG. 17 shows the pen nib in FIG. 16 viewed from its back side.

Reference numeral la represents a pen nib, which includes pen nib pieces 2*a* made of metal, ceramic or metal plate. The pen nib piece 2*a* is shaped triangular at the front end portion thereof and bent like a boat along two lines which are separated by a certain length from its longitudinal center line (FIG. 17).

As seen in the case of the first and second examples of the multiangular pen, the pen nib 1*a* comprises by bonding three of the pen nib pieces 2*a* back-to-back to one another according to the spot welding and gathering their tips together as a unit. The pen nib piece 2*a* is bent along the lines 3*a* like a boat, as described above, and when these three pen nib pieces 2*a* are bonded back-to-back to form the pen nib 1*a*, therefore, a channel 6*a* having such a comparatively large diameter that enables the ink introducing core to be passed therethrough is formed along the center axis of the pen nib 1*a*.

Figure 18:
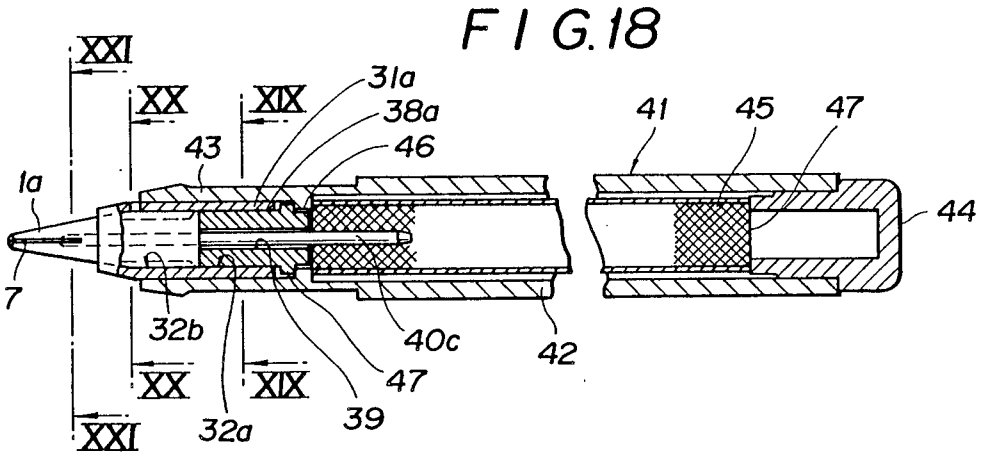
FIG. 18 is a sectional view showing the inside construction of the third example of the multiangular pen according to the present invention.

FIG. 18 is a sectional view showing an arrangement of the third multiangular pen according to the present invention. Reference numeral 31*a* denotes a pen nib holder sleeve having same construction as that of the one employed by the second example of the multiangular pen. This pen nib holder sleeve 31*a* is different from the one of the second example in that no holder piece is provided.

Reference numeral 38*a* represents a push sleeve inserted into a pen nib housing hole 32*a* in the pen nib holder sleeve 31*a* at the base end side of the holder sleeve 31*a*. This push sleeve 38*a* has a through-hole therein, which serves as a guide hole 39*a* having a circular section and allowing an ink introducing core to be passed therethrough and whose outer diameter is made a little larger than the inner diameter of the pen nib housing hole 32*a*. The push sleeve 38*a* is pressed into the pen nib housing hole 32*a* and fixed there.

Reference numeral 40*c* represents an ink introducing core, which has such a diameter that allows itself to be passed through the hole 39*a* in the push sleeve 38*a* and which also has such a smaller diameter at the front end portion thereof that allows that portion to be passed through the narrow channel 6*a*. This ink introducing core 40*c* is made of liquid permeating material such as polyester, nylon, acryl, felt, glass fibers and cotton. A core made by injection-molding a porous resin such as polyacetal may be used.

The pen nib 1*a* is inserted into the pen nib housing holes 32*a* and 32*b* in the pen nib holder sleeve 31*a* at the base (or back) end side of the holder sleeve 31*a*, as seen in the case of the second example of the multiangular pen. The pen nib 1*a* has a tapered section whose diameter becomes smaller and smaller as it comes nearer and nearer the front end thereof. The pen nib housing hole 32*b* also has a tapered section at the front end of the pen nib holder sleeve whose diameter becomes smaller and smaller as it comes nearer and nearer the front end thereof. When the front end portion of the pen nib 1*a* is projected by a predetermined length from the front end of the pen nib holder sleeve 31*a*, therefore, the pen nib 1*a* is stopped by the front inner rim of the pen nib holder sleeve 31*a*. When the push sleeve 38*a* is pushed this time into the pen nib housing hole 32*a* at the base end side of the pen nib holder sleeve 31*a*, this push sleeve 38*a* fitted and pressed into the pen nib housing hole 32*a* strikes against the back end of the pen nib 1*a* at the front end thereof to rigidly fix and hold the pen nib 1*a* in the pen nib holder sleeve 31*a*. The pen nib 1*a*, pen nib holder sleeve 31*a*, push sleeve 38*a* and ink introducing core 40*c* are assembled in this manner to form a pen nib assembly employed by this third example of the multiangular pen. The pen nib assembly is attached to a penholder 41.

Figure 20:
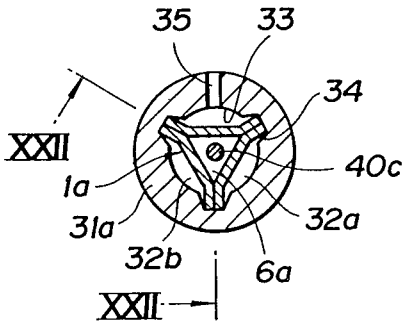
FIG. 20 is a sectional view taken along a line XX—XX in FIG. 18.
Figure 19:
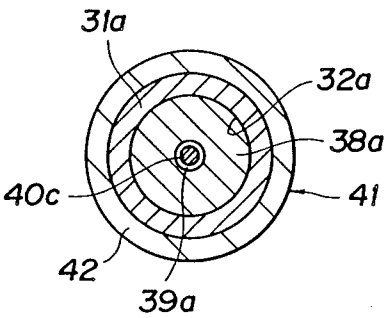
FIG. 19 is a sectional view taken along a line XIX—XIX in FIG. 18.
Figure 21:
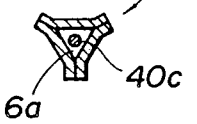
FIG. 21 is a sectional view taken along a line XXI—XXI in FIG. 18.
Figure 22:
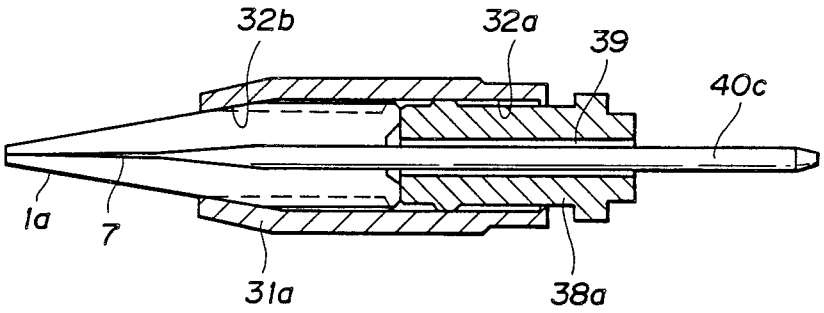
FIG. 22 is an enlarged sectional view taken along a line XXII—XXII in FIG. 20 showing in detail the construction of an pen nib assembly employed by the third example of the multiangular pen.

Ink moves from the ink holding member 45 to the base end of the ink introducing core 40*c*, passes through fibers in the ink introducing core 40*a* or pores in the injection-molded resin, and enters into the channel 6*a* in the pen nib 1*a*, passing through the push sleeve 38*a* and pen nib holder sleeve 31*a* (FIGS. 19 and 20). It is further introduced to the vicinity of the channel 6*a* (FIG. 21). As described above, the ink introducing core 40*c* contacts with the inner wall of the channel 6*a* or ink chamber 10 or the inside of the slits 7 at the front end portion of the pen nib 1*a* and ink is stored in the ink chamber 10 (see FIG. 10).

When the user uses the pen to write something on a sheet of paper, the ink stored in the ink chamber 10 permeates outside the pen nib 1*a* through all of the clearances 8 and slits 7 surrounding the ink chamber 10.

Although the present invention has been described with reference to its some preferred embodiments, it should be understood that various changes and modifications can be made without departing from the spirit and scope of the present invention.

What is claimed is:

1. A multiangular pen comprising a pen nib having a trunk extending in the longitudinal direction of the pen nib, plural projections radially and outwardly projected from the trunk with a certain angular interval interposed between the projections, plural slits each extending downward from a tip of the trunk between the projections, plural clearances each extending along the tip portion of the projection, and an ink chamber surrounded by the slits and projections, said slits and projections being alternately arranged and the tip portion of said pen nib being formed as a pyramid;

a pen nib holder sleeve having a pen nib housing hole extending along its center axis to house the pen nib and also having a tapered portion whose diameter becomes smaller and smaller as it comes nearer and nearer a front end thereof;

a push sleeve having a guide hole extending in its longitudinal direction and communicating with the pen nib housing hole, said push sleeve being fitted into the pen nib housing hole at a back end of said pen nib holder sleeve to strike against a back end face of said pen nib;

ink introducing cores made of fibers material and extending to the ink chamber, passing through the guide hole, and the pen nib housing hole;

a penholder for housing an assembly of the pen nib, pen nib holder sleeve and push sleeve; and an ink holding member;

wherein grooves are formed on the inner face of the pen nib housing hole in the pen nib holder sleeve to fix and hold the pen nib not to move in its rotating direction and one or more holder pieces each having a passage therein through which one of said ink introducing cores is passed is arranged integral to the front end of said pen nib holder sleeve.

2. A multiangular pen according to claim 1 wherein said pen nib fixing grooves are radially and outwardly formed on the inner face of the pen nib housing hole in said pen nib holder sleeve, extending in the longitudinal direction of the holder sleeve and the projections of said pen nib are fitted into the grooves to fix said pen nib not to move in its rotating direction.

3. A multiangular pen according to claim 2 wherein said pen nib is stopped in the pen nib housing hole by the tapered portion of said pen nib holder sleeve not to move in the forward direction.

4. A multiangular pen according to claim 3 wherein said pen nib in the pen nib housing hole is restricted by the push sleeve fitted into the pen nib holder sleeve not to move in the backward direction.

5. A multiangular pen according to claim 4 wherein each of said one or more holder pieces has such a section that can fit the trunk of said pen nib and can contact elastically with the trunk of said pen nib.

6. A multiangular pen according to claim 5 wherein the guide hole in the push sleeve has a three-forked section.

7. A multiangular pen according to claim 6 wherein said ink introducing cores extend from the ink holding member, passing through the guide hole in the push sleeve, between the inner face of the pen nib housing hole and the pen nib, and passages in the holder pieces.

8. A multiangular pen according to claim 7 wherein the front end of each of said ink introducing cores is contacted with a corresponding one of said slits from outside the pen nib.

* * * * *